United States Patent [19]

Murasaki

[11] Patent Number: 4,757,931

[45] Date of Patent: Jul. 19, 1988

[54] GUIDE DEVICE FOR ELONGATE ARTICLE

[75] Inventor: Ryuichi Murasaki, Toyama, Japan

[73] Assignee: Yoshida Kogyo K. K., Tokyo, Japan

[21] Appl. No.: 927,130

[22] Filed: Nov. 5, 1986

[30] Foreign Application Priority Data

Nov. 18, 1985 [JP] Japan ..... 60-176097[U]

[51] Int. Cl.[4] ..... B65H 23/04

[52] U.S. Cl. ..... 226/199; 242/76

[58] Field of Search ..... 226/196, 199; 272/76, 272/157 R; 28/233, 268, 282

[56] References Cited

U.S. PATENT DOCUMENTS

| | | | |
|---|---|---|---|
| 741,463 | 10/1903 | Courville | 242/76 |
| 1,903,546 | 4/1933 | Kaufmann | 28/233 |
| 3,130,453 | 4/1964 | Haigler, Jr. | 28/282 X |
| 3,269,628 | 8/1966 | Tarver | 226/199 |
| 3,478,654 | 11/1969 | Willard | 226/199 X |
| 3,489,043 | 1/1970 | Dent | 226/199 X |
| 3,598,332 | 8/1971 | Sharkey | 242/76 X |
| 3,912,144 | 10/1975 | Arseneault | 242/76 X |

FOREIGN PATENT DOCUMENTS

| | | |
|---|---|---|
| 50-25495 | 8/1975 | Japan . |
| 51-47102 | 12/1976 | Japan . |
| 56-52563 | 12/1981 | Japan . |
| 57-43 | 1/1982 | Japan . |

*Primary Examiner*—David Werner

*Attorney, Agent, or Firm*—Hill, Van Santen, Steadman & Simpson

[57] ABSTRACT

A guide device for guiding an elongate article such as a surface-type fastener includes a turntable rotatably supported on a base plate, and a guide assembly supported on the turntable and comprising a plurality of guide units spaced circumferentially around the axis of rotation of the turntable and having different widths for guiding the elongate article. For guiding the elongate article, one of the guide units is brought up to an uppermost position and locked therein, and the elongate article is transversely positioned between a pair of flanges axially spaced by the width corresponding to that of the elongate article to be guided.

7 Claims, 3 Drawing Sheets

GUIDE DEVICE FOR ELONGATE ARTICLE

BACKGROUND OF THE INVENTION

1. Field of the Invention

The present invention relates to a device for guiding an elongate article such as a tape, particularly a surface-type fastener having engagement elements such as loops or hooks projecting from a foundation fabric piece.

2. Description of the Prior Art

Japanese Patent Publication No. 57-43 discloses a guide device for guiding an elongate article such as a tape, the guide device having a single cylindrical guide roll rotatable for guiding and feeding the elongate article through frictional contact therewith. As disclosed in Japanese Patent Publication Nos. 51-47102 and 56-52563, another known device for guiding and feeding an elongate article includes two upper and lower cylindrical guide rolls disposed parallel to each other. The elongate article is gripped between and fed by the guide rolls as they rotate. Since these cylindrical guide rolls have smooth circumferential surfaces, the elongate article guided thereby tends to move transversely back and forth on the guide rolls in the axial direction thereof, and hence to be fed in an undulated path across the guide rolls. Where a plurality of parallel elongate articles are guided by a pair of cylindrical guide rolls of the conventional design, adjacent ones of the elongate articles are apt to overlap each other because they fluctuate laterally on the guide rolls.

To solve the above problem, there has been proposed a guide device comprising a guide roll having a plurality of guide grooves for receiving and guiding a plurality of elongate articles, respectively, along their corresponding straight paths, while avoiding mutual overlapping interference between adjacent ones of the elongate articles (see Japanese Patent Publication No. 50-25495). The guide grooves are defined by distance-adjusting pieces alternating with roll elements projecting radially outwardly beyond the distance-adjusting pieces. For guiding elongate articles of different widths, the width of each of the guide grooves must be changed by replacing the distance-adjusting pieces to meet the width of the new elongate articles.

SUMMARY OF THE INVENTION

It is an object of the present invention to provide a guide device capable of guiding an elongate article without transverse fluctuation and also of guiding elongate articles of different widths without involving any complex width-changing adjustment process.

According to the present invention, a guide device for guiding an elongate article includes a turntable rotatably supported on a base plate, and a guide assembly supported on the turntable and comprising a plurality of guide units spaced circumferentially around the axis of rotation of the turntable and having different widths for guiding the elongate article. The guide device includes detent mechanisms for selectively locking one of the guide units at a time in a fixed position for guiding the elongate article. The guide units have respective centers in the direction of the axis which lie on one plane parallel to the base plate. Each of the guide units comprises an axial pin supported on the turntable, a collar fitted over the pin, and a pair or a plurality of pairs of flanges supported on the collar, the flanges in each pair of the guide units being axially spaced by the different widths, respectively.

For guiding the elongate article, one of the guide units is brought up to an uppermost position and locked therein, and the elongate article is transversely positioned between the flanges axially spaced by the width corresponding to that of the elongate article to be guided. Therefore, the elongate article is stably guided along a straight path by the guide unit without being transversely fluctuated on the guide unit. When an elongate article of a different width is to be guided, one of the guide units which the corresponding width is selected and brought up to the uppermost position.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
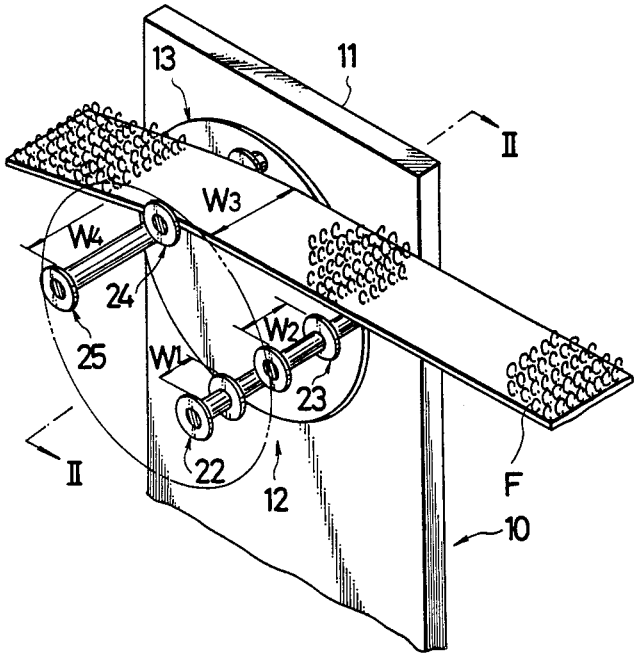
FIG. 1 is a perspective view, partly cut away, of a guide device according to the present invention.

Like or corresponding parts are denoted by like or corresponding reference characters throughout several views.

The principles of the present invention are particularly useful when embodied in the guide device, generally denoted by the reference numeral 10 in FIG. 1, for guiding an elongate article such as a surface-type fastener, a ribbon, or any of various narrow pieces of fabric or other materials.

As shown in FIG. 1, the guide device 10 generally comprises a base plate 11 extending vertically and a guide assembly 12 rotatably mounted on the base plate 11.

Figure 2:
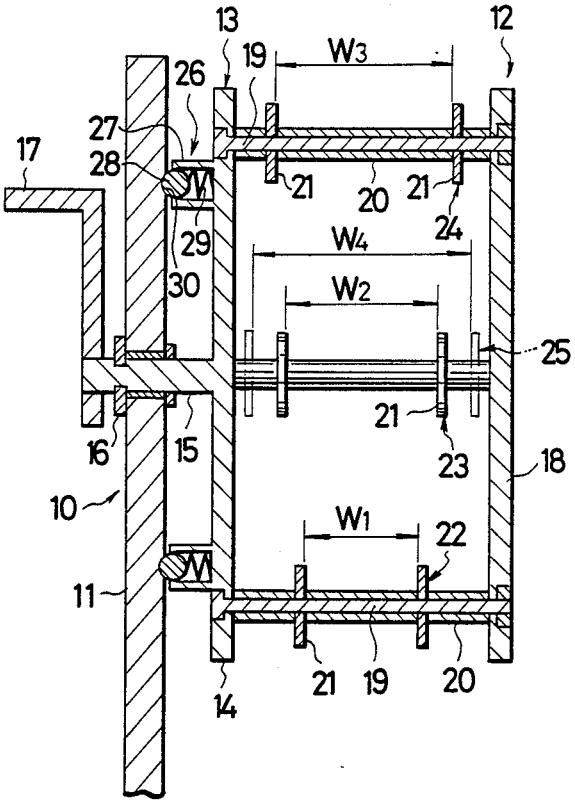
FIG. 2 is a cross-sectional view taken along line II—II of FIG. 1.

As illustrated in FIG. 2, the guide assembly 12 comprises a turntable 13 including a first circular side plate 14 having a coaxial shaft 15 projecting through and rotatably supported on the base plate 11 by a bearing 16. The shaft 15 can be rotated about its own axis by a handle 17 attached to the projecting end of the shaft 15. The turntable 13 also includes a second circular side plate 18 extending parallel to and spaced axially from the first circular side plate 14, the first and second circular side plates 14, 18 having the same diameter and being coaxial with each other.

The first and second circular side plates 14, 18 are interconnected by a plurality (four in FIGS. 1 and 2) of rods or pins 19 angularly spaced at equal intervals around the axis of the first and second circular side plates 14, 18. Therefore, the first and second side plates 14, 18 of the turntable 13 can be rotated about the axis of the shaft 15 by rotating the handle 17.

Each of the pins 19 has opposite ends fixed to the first and second side plates 14, 18. A collar or sleeve 20 is fitted over each of the pins 19 and extends from end to end thereon. Each collar 20 supports thereon a pair of flanges 21 axially spaced from each other and fixed to the collar 20 for locating an elongate article therebetween.

The paired flanges 21 on the four collars 20 are spaced from each other by different axial distances W1, W2, W3, W4 which are progressively greater in the described order, as shown in FIG. 2. The pins 19, the collars 20, and the flanges 21 spaced by the distances W1, W2, W3, W4 jointly constitute four guide units 22, 23, 24, 25, respectively.

The first side plate 14 has a plurality of detent mechanisms 26 spaced in the circumferential direction and positioned radially inwardly of the guide units 22 through 25. Each of the detent mechanisms 26 comprises a sleeve 27 disposed on the side surface of the side plate 14 facing the base plate 11 and projecting axially toward the base plate 11, the sleeve 27 having an open end defined by a constricted edge. A ball 28 is disposed in the sleeve 27 and is normally urged by a compression coil spring 29 in the sleeve 27 to be pressed against the base plate 11. The ball 28 is prevented from being displaced out of the sleeve 27 by its constricted end.

The base plate 11 has a plurality of recesses 30 defined in the side surface thereof facing the first side plate 14. Each of the recesses 30 receives part of one of the balls 28. When the balls 28 are partly received by the respective recesses 30, the turntable 13 is locked in one of angular positions with respect to the base plate 11. The detent mechanisms 26 are positioned such that when the turntable 13 is locked in one of the angular positions, one of the guide units 22 through 25 is located in an uppermost position for guiding an elongate article. In FIGS. 1 and 2, the guide unit 24 is locked in the uppermost position. Although not shown, it is possible to employ only one detent mechanism for locking one of the guide units 22–25 in the uppermost position, the detent mechanism consisting of either a combination of a single spring-loaded ball with four circumferentially spaced recesses, or a combination of four circumfrentially spaced, spring-loaded balls with a single recess.

The flanges 21 of the guide units 22 through 25 are positioned such that the centers of the respective guide units 22–25 in the longitudinal direction of the pins 19 lie in one vertical plane.

Figure 3:
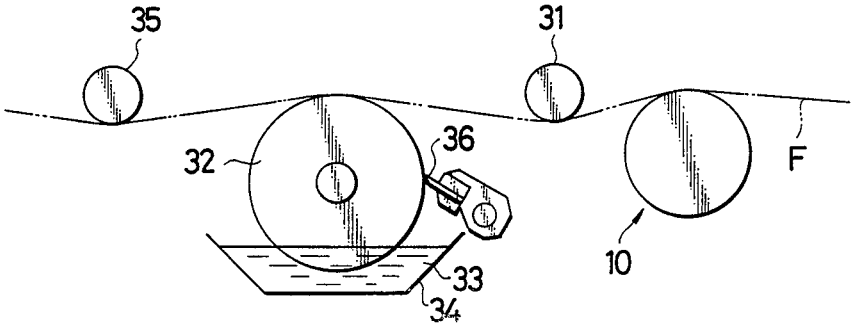
FIG. 3 is a schematic elevational view of an apparatus for coating surface-type fasteners, with the guide device of the invention being incorporated in the apparatus.

FIG. 3 shows an apparatus for coating surface-type fasteners F, the apparatus employing the guide devices 10 constructed as shown in FIGS. 1 and 2.

For guiding a plurality of spaced and juxtaposed surface-type fasteners F, a corresponding number of guide devices 10 are employed in the coating apparatus. The handles 17 of the guide devices 10 are turned so that the guide units having a width corresponding to that of the surface-type fasteners F to be guided are located in the uppermost positon. More specifically, as shown in FIGS. 1 and 2, each guide unit 24 having the width W3 for guiding a surface-type fastener F between the flanges 21 is brought into the uppermost position by turning the turntable 13 with the handle 17, and is locked in the uppermost position by the detent mechanisms 26. Then, the surface-type fastener F is transversely positioned between the flanges 21 of each guide unit 24. The surface-type fasteners F are guided by the guide devices 10 and an inlet guide roll 31 onto a rotating coating roll 32 that is partly immersed in a coating solution 33 contained in a coating bath 34. A plurality of spaced doctor blades 36 are held against the coating roll 32 to scrape the eccess coating solution off the coating roll 32, leaving parallel layers of the coating solution for application to the respective surface-type fasteners F. The surface-type fasteners F, with their backs coated with the coating solution, are then guided by an outlet guide roll 35 for a next process. The surface-type fasteners F can be fed along respective straight paths by the guide devices 10 of the present invention without being transversely fluctuated since each of the surface-type fasteners F is transversely positioned between the flanges 21. Therefore, the juxtaposed surface-type fasteners F are prevented from being overlapped or interfering with each other.

When a surface-type fastener having a different width corresponding to the distance W1, W2, or W3 is to be set on the guide device 10, the handle 17 is turned to move the guide unit 22, 23, or 25 into the uppermost position, in which the guide unit is automatically locked by the detent mechanisms 26. Since the guide units 22 through 25 have their centers in the same plane, the surface-type fastener desired to be guided is not manually required to be transversely shifted into proper alignment with the guide unit that has been brought up to the uppermost position, but can automatically be centered on the guide unit in the uppermost position. Inasmuch as the guide unit in the uppermost position is securely locked by the detent mechanisms 26, the surface-type fastener can be stably guided by the guide unit.

Figure 4:
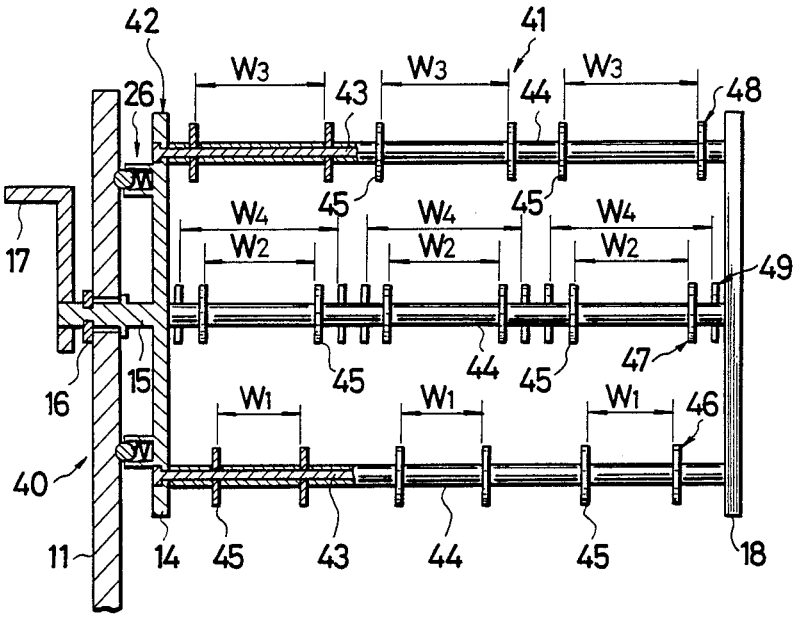
FIG. 4 is a side elevational view, partly in cross section, of a guide device according to another embodiment of the present invention.

FIG. 4 shows a guide device according to another embodiment of the present invention. The guide device, generally denoted at 40 in FIG. 4, differs from the guide unit 10 of FIGS. 1 and 2 in that each of guide units 46 through 49 of a guide assembly 41 on a turntable 42 comprises three pairs of axially spaced flanges 45 supported on a collar or sleeve 44 fitted over a pin 43 supported by and extending between the first and second side plates 14, 18. The flanges 45 in each pair of the guide unit 46 are spaced the distance W1, the flanges 45 in each pair of the guide unit 47 are spaced the distance W2, the flanges 45 in each pair of the guide unit 48 are spaced the distance W3, and the flanges 45 in each pair of guide unit 49 are spaced the distance W4. The guide device 40 can guide three spaced elongate articles with the guide unit locked in the uppermost positon. In FIG. 4, the guide unit 48 is in the uppermost position. The guide device 40 is advantageous for use with the coating apparatus shown in FIG. 3 since three surface-type fasteners can simultaneously be guided by the single guide device 40 into the coating apparatus.

Figure 5:
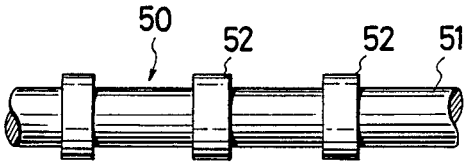
FIG. 5 is a fragmentary side elevational view of a guide rod according to still another embodiment of the present invention.

FIG. 5 illustrates a guide rod 51 of a circular cross section having a plurality of guide grooves 50 defined between axially spaced flanges 52, each of the guide grooves 50 having a predetermined width or flange-to-flange distance W. The guide units of a guide device may be composed of a plurality of guide rods 51, respectively, with their guide grooves 50 having different widths for guiding elongate articles of different widths.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A guide device for guiding a flexible elongate tape-like article, comprising:

(a) a base plate, (b) a turntable rotatably supported on said base plate for rotation about an axis, said turntable comprising a first circular side plate having a shaft coaxial with said axis and rotatably supported on said base plate, and a second circular side plate extending parallel to and spaced axially from said first circular side plate, said first and second side plates being coaxial with each other;

(c) a plurality of guide units supported on said turntable and extending parallel to said axis between said first and second side plates, said guide units being angularly spaced at equal intervals around said axis and having different widths for guiding the flexible elongate tape-like article along a path extending perpendicular to said axis, each of said guide units including a flanged pin connected at its opposite ends with said first and second side plates, and at least one pair of flanges disposed on said pin, the flanges of said guide units being axially spaced by said different widths; and (d) detent means for selectively locking one of said guide units at a time in a fixed position.

2. A guide device according to claim 1, said detent means including a plurality of recesses defined in said base plate and angularly spaced at equal intervals around said axis, and at least one spring-biased ball mounted on said first side plate and partly receivable in said recesses.

3. A guide device according to claim 1, further including a handle attached to an end of said shaft for turning said turntable.

4. A guide device according to claim 1, each of said guide units further including a collar fitted over said pin and supporting thereon said at least one pair of flanges.

5. A guide device according to claim 4, said collar supporting thereon a plurality of pairs of said flanges, the flanges in each pair of said guide units being axially spaced by said different widths.

6. A guide device according to claim 1, each of said guide units further having a plurality of peripheral guide grooves each defined between said pair of flanges, each said guide groove having one of said different widths.

7. A guide device according to claim 1, said guide units having respective centers in the direction of said axis which lie in one plane parallel to said base plate.

* * * * *